US005240190A

United States Patent [19]

Johnson

[11] Patent Number: 5,240,190

[45] Date of Patent: Aug. 31, 1993

[54] HAMMER MILL

[75] Inventor: Thomas H. Johnson, Winnebago, Minn.

[73] Assignee: Weigh-Tronix, Inc., Fairmont, Minn.

[21] Appl. No.: 929,960

[22] Filed: Aug. 14, 1992

[51] Int. Cl.[5] ..... B02C 13/04

[52] U.S. Cl. ..... 241/74; 241/92; 241/154; 241/189.1

[58] Field of Search ..... 241/27, 92, 154, 189.1, 241/74

[56] References Cited

U.S. PATENT DOCUMENTS

| | | | |
|---|---|---|---|
| Re. 28,677 | 1/1976 | Blakley et al. . | |
| 1,845 | 10/1840 | Barrett . | |
| 302,387 | 7/1884 | Engel . | |
| 3,577,998 | 5/1971 | Pinkham . | |
| 3,584,334 | 6/1971 | Moriya . . | |
| 3,643,879 | 2/1972 | Palyi | 241/55 |
| 3,807,644 | 4/1974 | Van Ee . | |
| 4,146,185 | 3/1979 | Schober . | |
| 4,214,716 | 7/1980 | Jadouin . | |
| 4,729,516 | 3/1988 | Williams, Jr. | 241/186.4 |
| 4,848,677 | 7/1989 | Rayner | 241/40 |
| 4,907,750 | 3/1990 | Seifert | 241/73 |
| 4,951,882 | 8/1990 | Ober | 241/55 |

OTHER PUBLICATIONS

"First Step: Grind It Right", *Hammer Mills*, Fall, 1990.

*Primary Examiner*—Mark Rosenbaum
*Assistant Examiner*—John M. Husar
*Attorney, Agent, or Firm*—Merchant, Gould, Smith, Edell, Welter & Schmidt

[57] ABSTRACT

The invention is a center fed hammer mill having a base plate, one or more intermediate plates having a central opening or hole, the intermediate plates being held together in fixed relative position by pins running through the outer edge of the intermediate plates, one or more hammers attached to the pins and a top plate having a central hole which is coextensive with the central hole of the intermediate plates, as well as a tube affixed to the top plate. The invention also comprises a method of using a center fed hammer mill.

14 Claims, 5 Drawing Sheets

FIG. 2
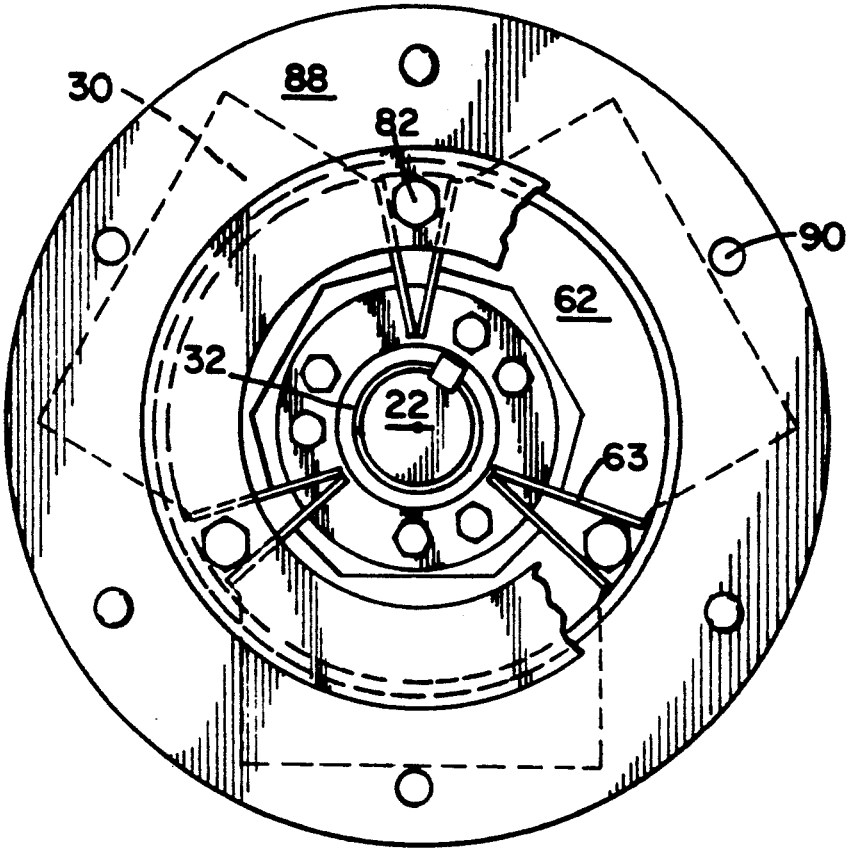
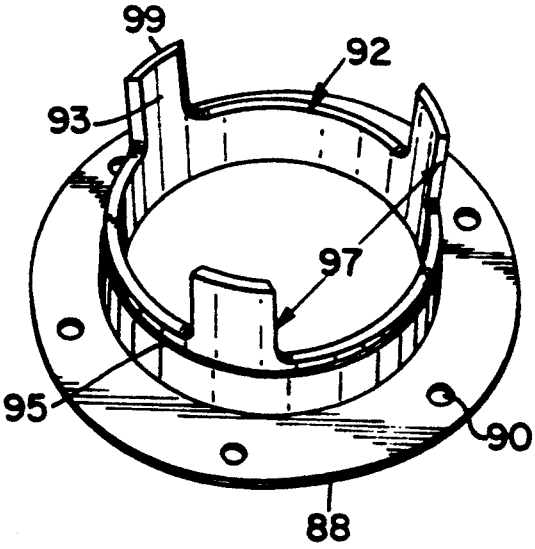
FIG. 3

FIG.6
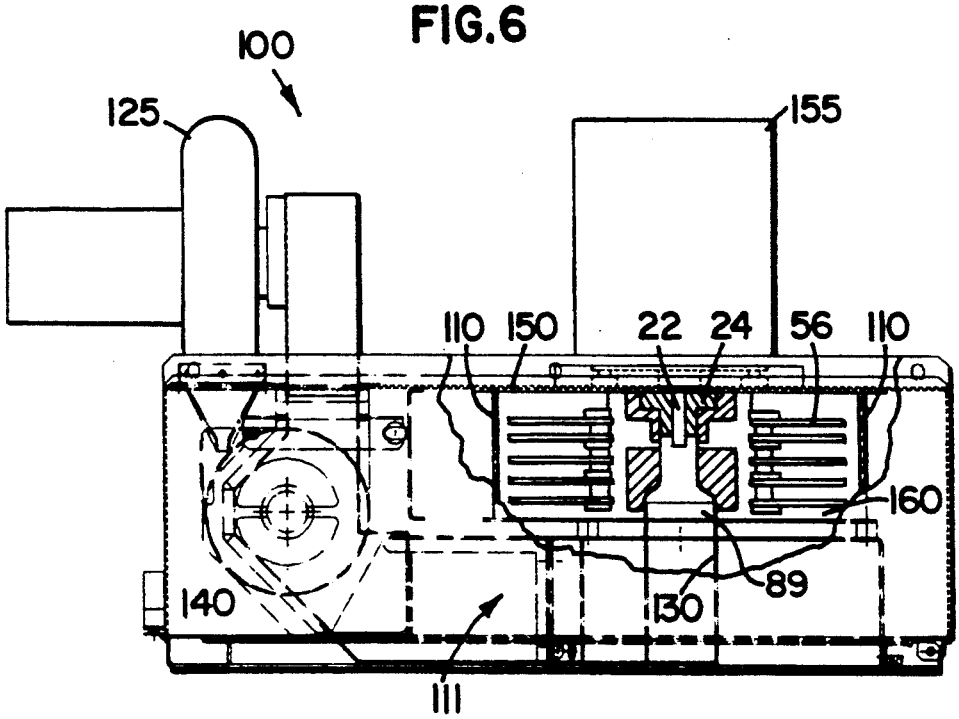
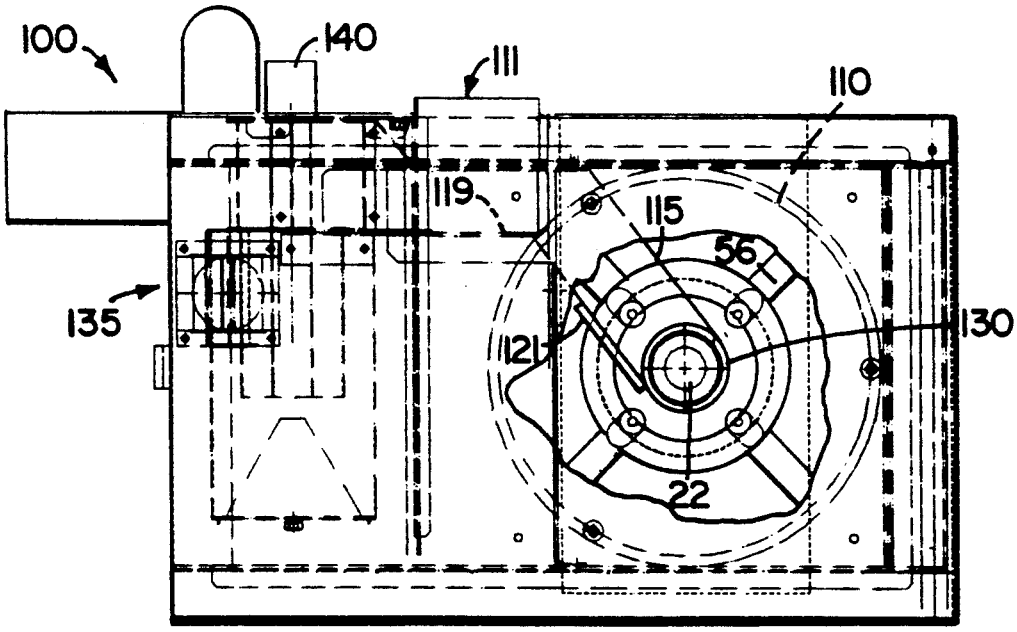
FIG. 7

HAMMER MILL

FIELD OF THE INVENTION

This invention relates generally to grinding apparatus and methods for grinding particulate compositions. More specifically, this invention relates to milling apparatus having movable hammers which also comprise a central opening or orifice for accepting product.

BACKGROUND OF THE INVENTION

A hammer mill in general is a rotating machine for reducing the size of a product to a smaller desired size. Hammers, either rigid or free swinging, are attached to a shaft. These hammers rotate as the shaft rotates and the tips of the hammers define a circle within their traveled path. These hammers may be any of a variety of possible shapes, but the outside tips, away from the supporting shafts axis of rotation, do the useful work.

Particles are reduced in size by explosion due to impact with hammer faces, cutting by the edge of the hammers and attrition or rubbing action on the sides of the hammers. Product which enters the mill in a reduced screen area will develop a greater amount of impact or rubbing action with the sides of the hammers causing heat and fines or dust. Product which enters from the side of the screen will have a larger amount of rubbing contact with the first row of hammers causing fines, heat, and excessive outside row hammer wear.

Hammer mills represent a well known device for the grinding decomposition of particulate material such as grains, stone, etc. Generally, the particulate material is fed into the mill and ground by the action of the hammers against the outer screen. Schober, U.S. Pat. No. 4,146,185 discloses a refuse shredder which has a series of extended plates held together on mounting shafts with removable hammers attached to the shafts. Van Ee, U.S. Pat. No. 3,807,644 discloses a chopper pump capable of chopping suspended organic particles which includes a central orifice for directing food into the chopping element. Organic material is ground or macerated by the action of rotating vanes which pass over stationary blades and a holding plate.

Engel, U.S. Pat. No. 302,387 discloses a sugar mixing and cooling apparatus which has a center feed into which sugar is introduced to come in contact with a revolving plate. Through the action of the plate, composition is directed downward and outward. Moriya, U.S. Pat. No. 3,584,334 discloses a granulator comprising several tiers of rotary blades through which particles are dropped. Moriya uses a central orifice to introduce particles into the granulator into which they drop through a blade system onto a series of plates. The particles are then sorted and flushed from the granulator.

Barrett, U.S. Pat. No. 1,845 discloses a means for separating garlic from grain through the introduction of grain into a center fed sorter. The active element in the separating device includes a system of cylindrical channels which, by forcing the separated shaft to the outside of the system, drop the shaft off into a storage drum. Blakley et al, U.S. Reissue Pat. No. 28,677 disclose a center feed waste treatment system in which waste is pumped into a holding vat and then churned and recycled to decompose organic material present in the system.

Jadouin, U.S. Pat. No. 4,214,716 discloses a center feed pulverizer including hammer elements on a central rotor which interact with impeller elements on the outer circumference of the drum which are complementarily positioned. Pinkham, U.S. Pat. No. 3,577,998 discloses a side feed impact device which has a central turbine containing hammers or rotor arms which when rotating contact elements introduced into the apparatus. Positioned on the side walls of the apparatus are impellers or arms which are complementary fixed given the action of the hammers.

However, in operation, prior art hammer mills generally forced the product into the screen by gravity. This force must be strong enough to overcome the air pressure from the fan effect of the rotating hammers.

Further, in units where the screen is a full cylinder in shape, the product is fed from the side of the cylinder. The hammers at the feed side wear more rapidly than the other hammers, since all of the product must pass through these outside edge hammers to reach the other hammers. Product is mainly introduced at the lower quadrant of the screen. As a result, an active grinding area of a comma shape is produced in the grinding chamber, utilizing one portion of the screen more than the rest.

In units where the screen is not a full cylinder in shape, product is fed into the screen radially toward the center to the hammers. Such mills may generally comprise a tear-dropped shaped screen or semi-circular screen with product introduced into the mill through the rotating hammers at the millside. A blower may generally be required to overcome the outward blowing effect of the hammers by either pressurizing the inlet or providing vacuum on the outside of the screen to provide air flow through the screen. The product is introduced at one or the other edge of an arc of a cylindrical section in a circumferential direction providing less than a 360° arc of active grinding area.

As a result, there is a need for a hammer mill which allows for even grinding of product, minimal wear of mill components and easy replacement of components when necessary, among other benefits.

SUMMARY OF THE INVENTION

In accordance with a first aspect of the invention there is provided a hammer mill having a base assembly, grinding means, and a head assembly having a central opening for the acceptance of product.

In accordance with a second aspect of the invention there is provided a center fed hammer mill having a base plate, one or more intermediate grinding plates, one or more hammers, and a top plate. In accordance with a further aspect of the invention there is provided a method of using the center fed hammer mill of the invention.

The hammer mill of the invention has a central tube into which product is introduced. Preferably, this tube has openings machined in it at regular intervals. The mill generally allows product to accumulate on the inside circumference of the tube.

Newly introduced product then may initially wear against accumulated product at the interior of the mill instead of the mill hammers. The wear areas of the mill thus include the edges of the mill interior such as the impeller part edges exposed to the product.

The invention may include a mill design which allows for the intermediate grinding assembly which may be removed while leaving the base assembly of the mill on the shaft. This allows for easy replacement of the hammers and other mill elements exposed to wear. Impeller elements may also be provided as replaceable wearing surfaces within the hub to prevent structural elements from wearing. These impeller elements may be provided in any number of various configurations to provide the best performance in each application.

In operation, the product enters the screened grinding chamber through a central opening in the head assembly. The rotation of the mill causes a centrifugal force which drives the product against the impeller blades. Centrifugal force drives the product out to the edges of the screen thereby utilizing the screen as the active area. This provides an even distribution of particles small enough to easily pass through the screen.

Upon introduction into the mill screened area, the product is exposed immediately to several rows of hammers producing more cutting action and less rubbing action. This reduces product heating and allows more energy to be used for particle reduction. The positive pressure against the screen helps prevent the holes from becoming plugged, and allows finer screens to be used with good particle size consistency, and efficiency without excessive heating.

As a result, the hammers in the invention last much longer, and wear uniformly as compared to prior art mills. More horsepower may be used without a significant loss of performance efficiency. The mill load is not limited by the inability of introducing more product into the screen because of pressure forcing the product toward the inlet and plugging it.

BRIEF DESCRIPTION OF THE DRAWINGS

FIG. 2 is a partially cutaway top plan view of the hammer mill shown in FIG. 1.

FIG. 3 is a perspective view of one element of the head assembly in accordance with one embodiment of the invention.

FIG. 6 is a top plan view of a hammer mill apparatus in a partial cutaway cross-section in accordance with one embodiment of the hammer mill of the invention.

FIG. 7 is a side plan view of the hammer mill of the invention shown in FIG. 6.

DETAILED DESCRIPTION OF THE PREFERRED EMBODIMENTS

Figure 1:
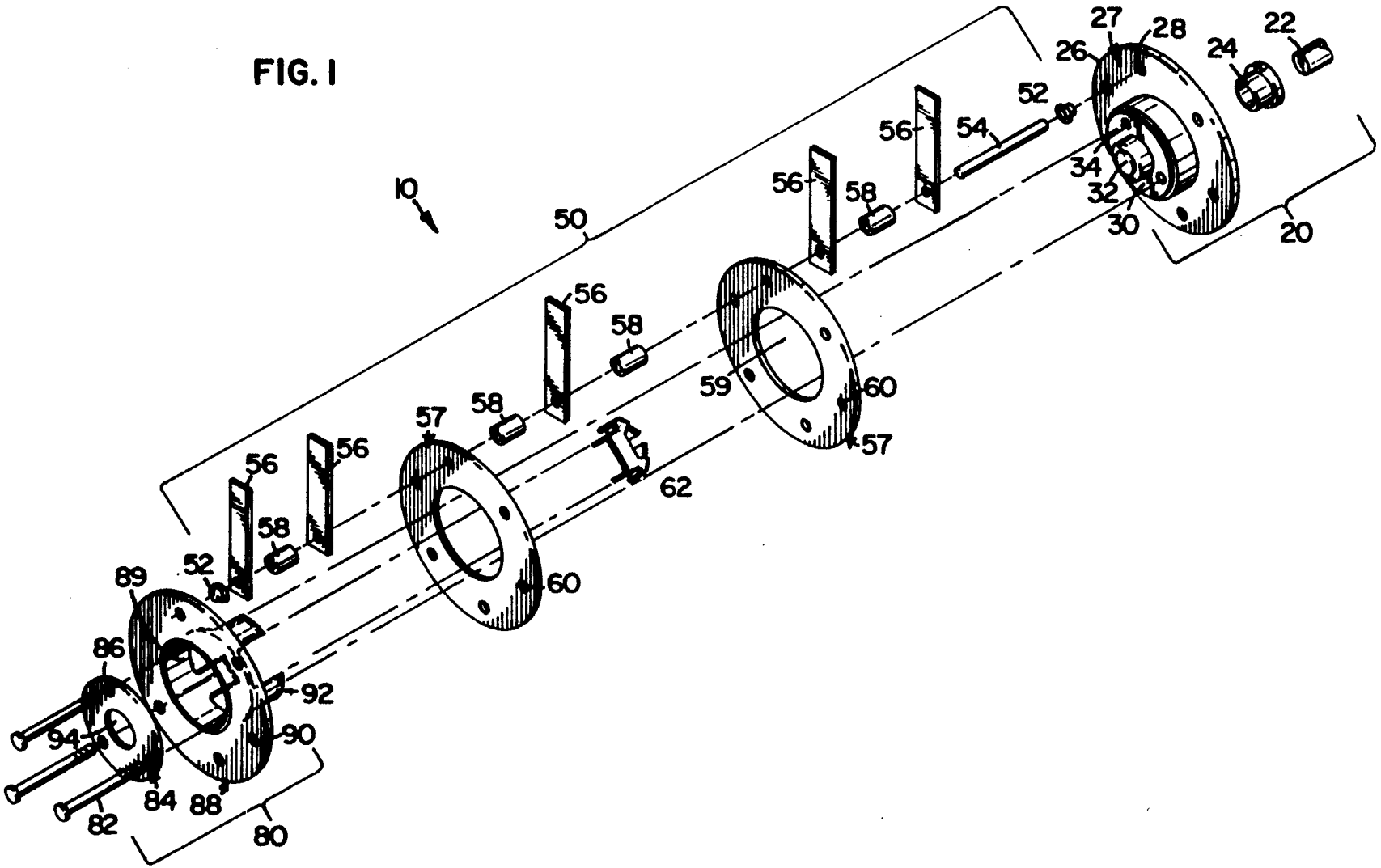
FIG. 1 is an exploded perspective view of a partial assembly of one embodiment of a hammer mill in accordance with the invention.

Referring to the drawings wherein like numerals represent like parts throughout several views, there is generally shown a hammer mill in FIG. 1. The hammer mill generally comprises a base assembly 20, a grinding assembly 50, and a head assembly 80. The base assembly may comprise a mill shaft 22 to which is connected an adapter 24 and a base plate 26.

The base plate 26 generally comprises an outer perimeter 27 in which may be found holes 28 for the secured attachment of the intermediate grinding assembly 50. The base assembly may also comprise an opening or orifice 32 for seating the shaft 22 as well as a raised central portion 30 which may function to seat the additional elements of the mill as well as accepting the through bolts 82 which are passed through lock plate 84 to secure the mill assembly in place.

The hammer mill of the invention may also comprise an intermediate grinding assembly 50 generally comprising one or more intermediate support rings 58. In each support ring, holes 60 are positioned at the perimeter of the plate 58 for the acceptance of pins 54. The pins are used to secure hammers 56 and spacers 58 in place throughout the length of the grinding assembly 50. The hammers 56 and spacers 58 may be fixed in place by any means known to those of skill in the art including end caps 52. The end caps 52 are designed to releasably seat within the holes 28 found in the outer perimeter of the base plate 26 and the holes 90 found in the outer perimeter of the head plate 88.

Although FIG. 1 shows only a partial assembly of one embodiment of the mill of the invention, it will be understood by those of skill in the art that pins 54 and hammers 56 may be placed throughout the circumference of the intermediate grinding plates 57. For example, as shown in FIG. 1, the intermediate grinding plates 57 as well as the base plate 26 and head plate 88 have the capacity to hold, support and fix in place six pins 54 each holding a set of spacers 58 and hammers 56.

Generally, the invention may also comprise a head plate 88. Here again, the outer perimeter of the head plate generally comprises holes 90 for the releasably acceptance of means such as end caps 52 for the fixing of the pins 54. Preferably, the head plate 88 also comprises a tube 92 which functions to accept the introduction of product through opening 89 to be ground as well as to seat impellers 62 which additionally assist in the grinding of product.

The grinding assembly of the mill 50 is releasably seated between the base assembly 20 and the head assembly 80 by the introduction of through-bolts 82 into lock plate 84.

As can be seen in FIG. 1, through-bolts 82 are introduced into lock plate 84 and are then seated within the central raised portion 30 of base plate 26. Through this preferred design of the mill of the invention, it is possible to release the grinding assembly 50 simply by releasing or unscrewing the through-bolts 82 and detaching the lock plate 84 and head plate 88. The grinding assembly 50 with the head assembly 80 may then simply be lifted from the base assembly 20.

The invention generally comprises a base assembly 20 which functions to transfer torque from the shaft to the mill assembly 10, the base assembly 20 serves as a receptacle for various attachment means which may be used in any number of plate assemblies. Generally, the base assembly may comprise any number of shapes consistent with the functions outlined above. Preferably, the base assembly 20 is concentric with the drive shaft 22 for high speed balance.

Figure 5:
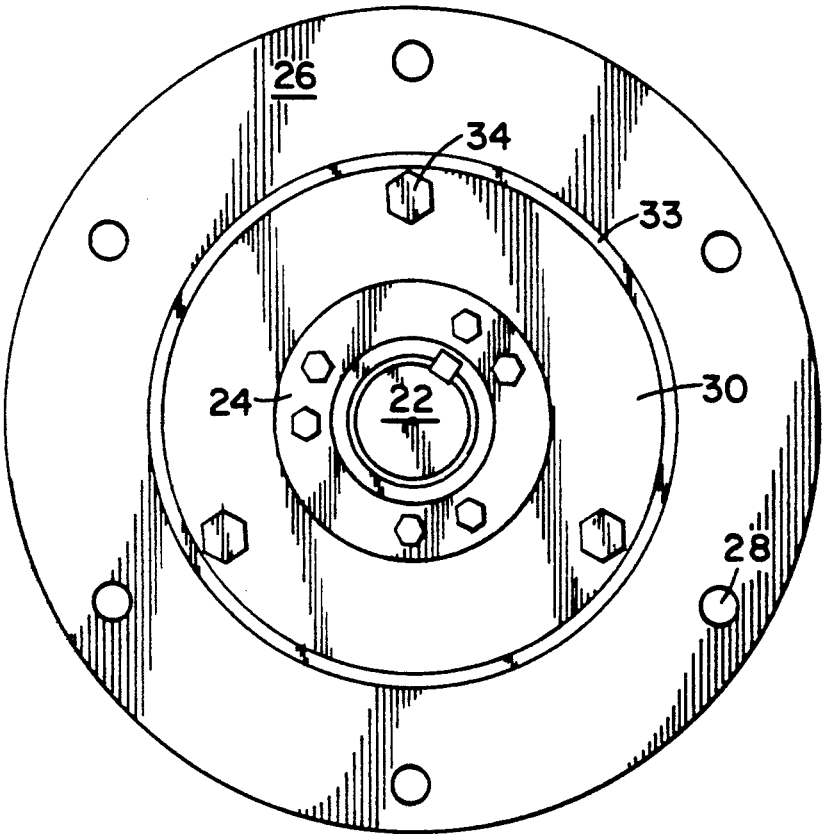
FIG. 5 is a top plan view of the base assembly of a hammer mill in accordance with one aspect of the invention.

Preferably, as can be seen in FIGS. 1 and 5, a base plate 26 may have a cylindrical outer perimeter 27 which comprises any number of holes 28 for receipt of pin means 54. Preferably, pin means 54 are releasably received and held in the outer perimeter 27 of the base plate 26. The base plate 26 may also comprise a raised inner portion 30. This inner portion 30 functions to receive a shaft 22 as well as adapter 24 and transfer the motion of the shaft 22 to the remainder of the mill assembly 50, 80.

Further, this raised central portion 30 of the base plate 26 also functions to receive any variety of attachment means (such as through bolts 82) which are used to secure the assembly to the shaft 22.

The invention may also comprise a grinding assembly 50. The grinding assembly 50 functions to assist in holding the hammers 56 through pin means 54 which are passed through the outer perimeter of plates 57. To this end, the intermediate plates 57 also function to transfer torque to the pins 54 and create the necessary action within the hammers 56.

The intermediate plates may comprise any number of designs consistent with this function. As can be seen in FIG. 1, the intermediate plates 57, are generally self-contained circular plates having an open central area 59 through which product is introduced. The plates 57 generally comprise any number of holes 60 at the outer perimeter through which are passed pin means 54 used to connect and hold hammers 56. The hammers 56 are separated by spacers 58. The spacers 58, hammers 56, and plates 57 are interconnected through pin means 54 which are capped or secured by any means known to those of skill in the art including cap washers 52.

The mill of the invention also comprises a head assembly 80. Generally, the head assembly 80 functions similarly to the grinding assembly by transferring torque to the various pins 54 and, in turn, the hammers 56. Further, the head assembly also functions to provide an initial entry port for product as well as releasably hold the pin means 54 used to secure the hammers within the assembly.

Generally, the head assembly 80 may have any shape consistent with this function. Preferably, the head assembly has a head plate 88 which comprises a cylindrical disk having an outer perimeter containing holes 90 useful in releasably securing the pin means 54. The head plate 88 may also generally comprise an opening 89 which is coextensive in area and positioned with the openings 59 found in the intermediate plates 57.

A tube 92 may be positioned at the interior of the opening in the head plate 88. The tube may also be attached to the base assembly and pass through the openings in the grinding plates to adjoin the opening in the head plate. The tube may also function to hold the grinding plates in fixed position relative to each other and the mill in general, The tube 92 functions to center the assembly upon the shaft 22 and provide a central distribution point for product to be milled. Further, the tube 92 may also be used to function to hold the impellers 62 when used.

Generally, the tube may comprise any number of shapes consistent with the functions outlined above. Preferably, as can be seen in FIG. 3 the tube 92 generally may comprise a cylindrical orifice which extends at 90° from the surface of the head plate 88. The tube 92 generally comprise three legs 93, between which openings 97 exist for the passage of grain or other products to the outer perimeter of the mill adjacent the screen.

Preferably, the tube is also milled or ground in two areas. Generally, the legs 93 of the tube are ground at surface 99 so that they will adequately seat upon the base assembly at groove 33, see FIG. 5. The tube may also preferably be milled to decrease the outer diameter of the tube thereby allowing seating of the tube, or in whole or in part, within the grinding assembly 50. The milling of the tube can be seen most clearly in FIG. 3 where bevel 95 represents the difference in the outer diameter between the portion of the tube closest to head plate 88 and the remainder of the tube.

Figure 4:
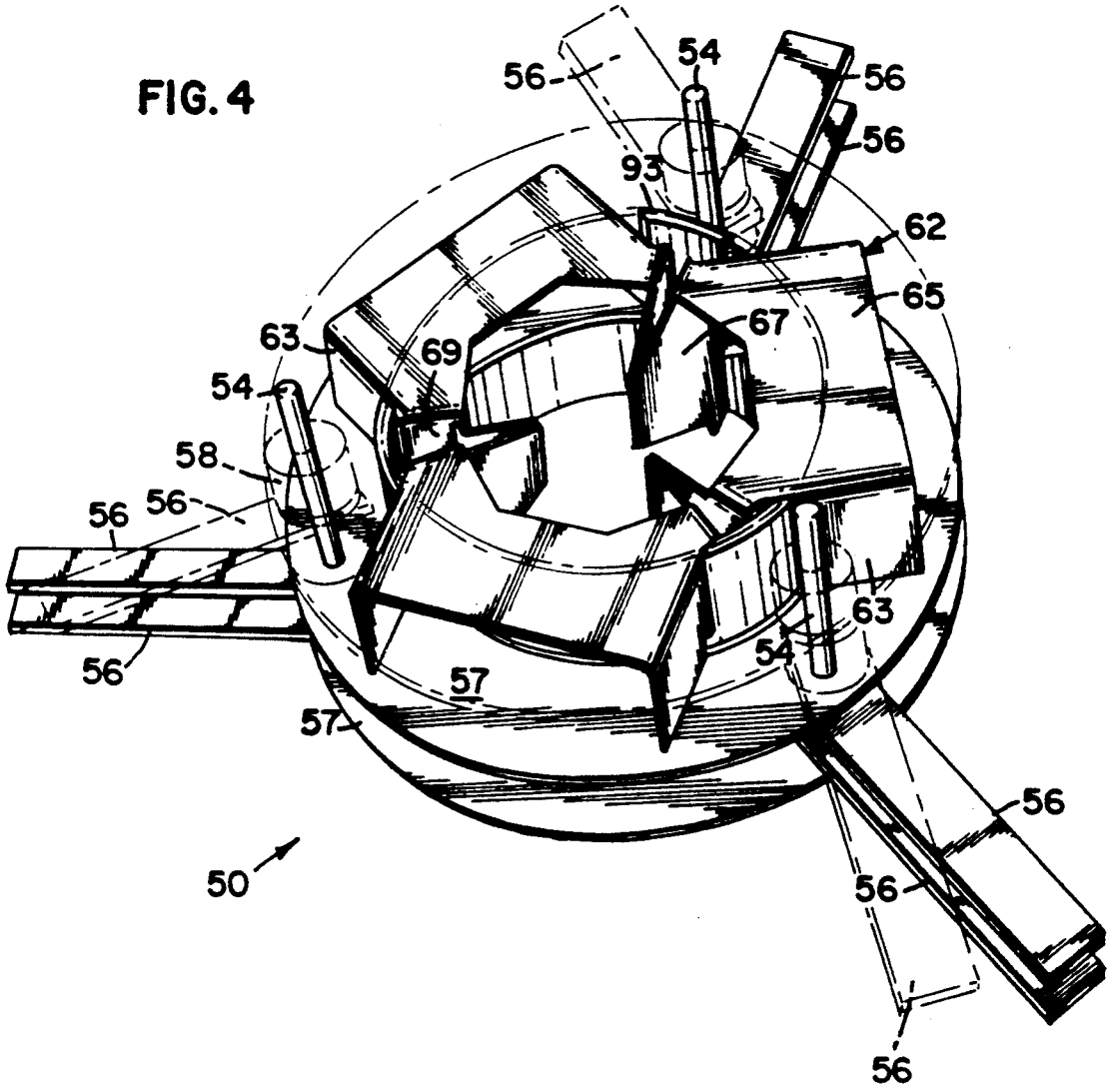
FIG. 4 is a perspective view of a partial assembly of a hammer mill in accordance with one aspect of the invention.

The head assembly of the mill of the invention may also comprise impellers 62, FIGS. 1 and 4. The impellers function as a pump to force material into the hammers and screen as well as additional cutting surfaces. The impellers 62, along with tube 92 and bolts 82, assist in distributing the wear on hammers 56. Generally, the impellers may comprise any design, shape or configuration consistent with this function.

One preferred design of the impellers can be seen in FIGS. 1 and 4. In this instance, the impellers 62 generally comprise a support portion having a top side 65 and side leg portions 63 which support the impeller blades 67 within the grinding assembly. As can be seen in FIG. 4, the impellers 62 generally rest in the open portion 97 of the tube between the tube legs 93. As shown in FIGS. 1 and 4, the impeller is held longitudinally in the mill between any of the plates. The impeller may be held radially within the mill by extending the impeller blades 67 into the head plate tube 92. The impellers function to protect rods 54, inserted through opening 69 (see FIGS. 1 and 4), and bolts 82 from material which from material flowing outward from the central opening of the mill. The impeller blades 67 point inwardly towards the central opening of the hammer mill and specifically grinding assembly. Any number of impellers may be used depending on the application which the assembly is to be used. Alternatively, the impellers may be positioned above the head plate and function to drive product out to the side of the mill at the screen and then downward in an axial direction into contact with the hammers.

Turning to FIGS. 6 and 7, the complete mill assembly 100 may be seen. The mill may comprise a screen 110. The screen functions alone, and in combination with hammers 56, to grind and cut the product of choice once introduce into the mill. To this end the screen may comprise any shape or form consistent with this function. Generally, the screen is cylindrical following the action of the hammers 56 upon activation of the assembly.

Preferably, the mill screen used is cylindrical and contains necessary reference fixtures to hold it in place while the door is open. The screen may be manufactured from perforated steel sheets with any shaped hole desired, a round hole shape is preferred. Mesh size generally ranges from about 0.06 inches to 1.0 inches. Screen thickness generally ranges from about 0.03 inch to 0.25 inch, and preferably from about 0.06 inch to 0.13 inch.

The screen may be of any thickness desired, but thinner screens work best, for particle size consistency. More holes per screen surface area also improves mill performance. The screen should be round. The screen should preferably be centered on the cylinder assembly so that a constant clearance exists between the hammers and the screen as the hammers rotate. Clearance between the screen and the hammers may range from about 0.06 inch to 1.0 inch. Screens which are off center will also cause poorer grinding performance in the mill.

In operation, grain may enter the housing through an entrance port 111 above the inner door 117. Product such as grain impinges on a lip platform 119 on the inner door 117. Heavy metal and dense rocks are trapped on this platform. The grain slides and is blown down the chute 115 in the inner door 117. A magnet 121 in this chute 115 catches ferromagnetic items which bounced from or were too small to be trapped on the platform 119.

The air resulting from blower 125 enters the center fed cylinder and blows the product, such as grain, into the center of the cylinder through the inlet tube 130 on the inner door. The grain is then forced through the opening 89 in the head plate 88 into the grinding assembly 50 where hammers 56 break and grind the product into particles small enough to pass through the screen 110. The ground grain then falls through the bottom of the mill housing into a removal device or holding vessel.

The air expelled through the mill screen is drawn into a blower 125 which forces the air through an inertial air cleaner 135 and back to the mill inlet tube 130 through the inner door 117. Air that is displaced by the entering grain or is drawn into the housing through openings in the mill housing is also drawn into the blower 125 and forced through the inertial air cleaner 135 and out of the mill housing through air exhaust 140 where it may be vented from the mill building through ducting.

The mill door is hinged and has latches to secure it in an adjustable closed position. A wear plate 160 on the door may be spring loaded and positioned so as to provide a clamping force against the screen when the door is closed to prevent the screen from rotating during operation.

A wear plate 150 on the rear of the mill housing may be used to reference the screen 110 to the mill assembly to provide concentric alignment. The mill assembly may be mounted on the drive shaft 22 on the motor device 155 with an adapter 24 such as a tapered bushing. The motor device 155 is referenced to the back of the mill housing with a structural plate to provide concentric alignment with the mill screen 110.

The hammer mill of the invention may be used for any number of applications in which impact, shearing or abrasion, decomposition of product is required. Generally, the hammer mill of the invention provides more shearing action due to its design. Once placed in a system, the invention may comprise a blower system having an internal circulating air system to maintain a constant flow of product through the mill.

The mill may also be used with an inertial separator as known to those of skill in the art which reduces particles entrained in the air from being exhausted. This separator relies on inertial energy to separate and not gravity. Further, the mill of the invention may be used in conjunction with a gravity separator which allows heavier articles such as metal fines, bolts, nuts and the like to separate out from the product to be milled.

The mill may be fed by any number of mixers including horizontal or vertical augers which can be used to increase mixing rate and the delivery rate of product to the invention.

The above specification, examples and data provide a complete description of the manufacture and use of the composition of the invention. Since many embodiments of the invention can be made without departing from the spirit and scope of the invention, the invention resides in the claims hereinafter appended.

I claim as my invention:

1. A center fed hammer mill comprising:

(a) a head plate having a central hole, said head plate comprising a tube affixed to said head plate and bordering said head plate central hole, said tube extending into said center fed hammer mill;

(b) grinding means releasably attached to said head plate, said grinding means comprising at least two grinding plates, each of said grinding plates having a central hole which is coextensive in area with said head plate central hole;

(c) pin means affixed to said grinding means;

(d) one or more hammers attached to said pin means, at least one of said hammers positioned between said grinding plates;

(e) a base assembly;

(f) at least one impeller, said impeller comprising at least one impeller blade, said impeller blade radially fixed within said head plate tube and longitudinally fixed between any two of said plates of the hammer mill assembly; and (g) bolt means extending from said base assembly through said grinding means to said head plate, wherein said bolt means and said pin means are protected from wear by said impellers.

2. The hammer mill of claim 1 wherein said pin means comprises one or more pins, each pin having one or more hammers attached thereto, wherein each hammer on a single pin is separated from adjacent hammers by a spacer.

3. The hammer mill of claim 2 wherein said pin means comprises six pins held within and positioned around the circumference of said grinding means.

4. The hammer mill of claim 1 additionally comprising a clamp plate adjacent said head plate, said base assembly affixed to said clamp plate by said bolt means.

5. The hammer mill of claim 4 wherein said grinding means, said pin means, and said hammers are detachable from said base assembly as a single unit.

6. The hammer mill of claim 1 additionally comprising a cylindrical screen fitted around said mill.

7. The hammer mill of claim 6 wherein the distance between said mill hammers and said screen ranges from about 0.06 to about 1 inch.

8. A center fed hammer mill comprising:

(a) a base plate;

(b) a first grinding plate having a central hole;

(c) a second grinding plate having a central hole coextensive with said first grinding plate central hole wherein said first and second grinding plates are attached by pin means running through the outer edge of said first and second grinding plates;

(d) one or more hammers attached to said pin means at least one of said hammers positioned between said first and second grinding plates;

(e) a head plate having a central hole coextensive with the central hole of said first and second grinding plates, said head plate comprising a tube affixed to said head plate and bordering said head plate said central hole, said tube extending into said center fed hammer mill;

(f) a clamp plate positioned above said head plate, said clamp plate fitted to receive through bolts which are releasably received in said base plate; and (g) one or more impellers, said impeller comprising at least one impeller blade, said impeller blade radially fixed within said head plate tube and longitudinally fixed between any two of said plates of the hammer mill, wherein said bolt means and said pin means are protected from wear by said impeller blade.

9. The hammer mill of claim 8 wherein said pin means comprises one or more pins, each pin having one or more hammers attached thereto.

10. The hammer mill of claim 9 wherein said pin means comprises six pins positioned around the circumference of said first and second grinding plates, wherein between said head plate and said first grinding plate each pin holds two hammers, between said first and second grinding plate each pin holds one hammer, and between said second grinding plate and said base plate each pin holds two hammers.

11. The hammer mill of claim 10 additionally comprising a cylindrical screen fitted around said mill.

12. The hammer mill of claim 11 wherein the distance between said mill hammers and said screen ranges from about 0.06 to about 1 inch.

13. The hammer mill of claim 8 wherein said base plate is fitted onto a rotatable shaft.

14. The hammer mill of claim 8 wherein said first grinding plate, said second grinding plate, said pin means, and said hammers are detachable from said base plate as a single unit.

* * * * *